US006571957B1

(12) United States Patent
Doelle et al.

(10) Patent No.: US 6,571,957 B1
(45) Date of Patent: Jun. 3, 2003

(54) SCREENING APPARATUS FOR FIBER SUSPENSION

(75) Inventors: Klaus Doelle, Menasha, WI (US); Robert J. Matz, Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 0 days.

(21) Appl. No.: 09/633,510

(22) Filed: Aug. 7, 2000

(51) Int. Cl.[7] ..... B07B 1/04; D21D 5/02

(52) U.S. Cl. ..... 209/273; 209/306; 210/415; 162/261; 162/380

(58) Field of Search ..... 209/273, 281, 209/283, 300, 305, 306; 210/413, 414, 415; 162/55, 251, 261, 380

(56) References Cited

U.S. PATENT DOCUMENTS 3,912,622 A 10/1975 Bolton, III et al. ..... 209/17
5,041,213 A * 8/1991 Holopainen et al. ..... 209/273
5,435,444 A 7/1995 Satomi ..... 209/234
5,597,075 A 1/1997 Iwashige et al. ..... 209/10
5,798,025 A 8/1998 Iwashige ..... 162/261
5,899,338 A * 5/1999 Fredriksson ..... 210/413 X
6,155,427 A * 12/2000 Pimley ..... 209/306 X

FOREIGN PATENT DOCUMENTS

DE 197 02 044 C1 4/1998
WO 94/23848 * 10/1994 ..... 209/306

* cited by examiner

*Primary Examiner*—Tuan N. Nguyen
(74) *Attorney, Agent, or Firm*—Taylor & Aust, P.C.

(57) ABSTRACT

A screening apparatus for screening acceptable and rejectable material from a pressurized fiber suspension includes a housing and a rotor within the housing. The rotor has a top end. A screen basket is positioned generally concentrically around the rotor. A rotor blade ring is connected to the top end of the rotor and rotates with the rotor. A stationary defibering ring is positioned adjacent to the rotor blade ring.

17 Claims, 4 Drawing Sheets

SCREENING APPARATUS FOR FIBER SUSPENSION

BACKGROUND OF THE INVENTION

1. Field of the Invention

The present invention relates to a screening apparatus used to screen acceptable and rejectable material from a fiber suspension, and, more particularly, relates to such a screening apparatus including a screen basket concentrically positioned relative to a rotor.

2. Description of the Related Art

In the paper-making process, a screening apparatus is typically used to separate foreign matter from a fiber suspension. A typical screening apparatus may include a housing within which a screen basket is mounted around a concentrically positioned rotor assembly. The screen basket may be fabricated from a relatively thin metal plate material although bar or wire materials are also often used and when mounted in a screening apparatus provide a barrier between a screening chamber and an accept chamber. The fiber suspension is transported into the screening chamber by way of a feed inlet. The fiber suspension is introduced to either the inner or outer portion of the screen basket, depending upon the particular type of screening apparatus being used. Material which does not pass through the screen basket flows to an end of the screening chamber away from the feed inlet and is removed through a reject outlet.

One known type of screen basket has circular shaped openings sized to reject unwanted solids and may have support rings located along the length of the basket to provide additional mechanical support. Another type of screen basket has slots having lengths much greater than their widths for separating other types of materials and may have support rings located along the length of the screen basket to provide additional mechanical support. Yet another type of screen basket includes longitudinally extending wires which are attached at each end thereof to respective annular retaining rings. The retaining rings are used to mount the screen basket within the screening apparatus. The retaining rings are bolted to a stationary member to prevent the screen basket from rotating in response to the torsional forces generated by the rotating hydrofoils or drum.

The rotor assembly generally includes hydrofoils or a contoured drum mounted on a rotating shaft in close proximity to the screen basket to sweep past the openings of the screen basket. The hydrofoils or contoured drum may be positioned to sweep over the inner or outer surface of the screen basket. The rotating hydrofoils or contoured drum generate hydrodynamic pulses in the radial direction with enough force and frequency to continuously remove any fiber plugs that occur in the screen basket openings. The localized flows caused by the hydrodynamic pulses are generally in a direction opposite to the flow of the fluid pulp provided to the screen basket under pressure.

With a screening apparatus as described above, flaking, defibering and screening occur almost entirely within the rotor as a result of hydrodynamic actions and pressure pulsations caused by the rotating foils within the rotor. Although such screening apparatus further result in effective screening of the fiber suspension, the rejects rate may be higher than desired because of insufficient deflaking and defibering.

What is needed in the art is a screening apparatus which provides improved deflaking, defibering and screening of the fiber suspension, thereby resulting in an increased accepts rate with lower power input requirements.

SUMMARY OF THE INVENTION

The present invention provides a screening apparatus including a rotor, a stationary defibering ring positioned above the rotor, and a rotor blade ring carried by the rotor and positioned above the stationary defibering ring.

The invention comprises, in one form thereof, a screening apparatus for screening acceptable and rejectable material from a pressurized fiber suspension, including a housing and a rotor within the housing. The rotor has a top end. A screen basket is positioned generally concentrically around the rotor. A rotor blade ring is connected to the top end of the rotor and rotates with the rotor. A stationary defibering ring is positioned adjacent to the rotor blade ring.

An advantage of the present invention is that improved deflaking, defibering and screening is provided.

Another advantage is that the rotor blade ring and/or stationary defibering ring may be selected with one of multiple different configurations while still providing improved functionality.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
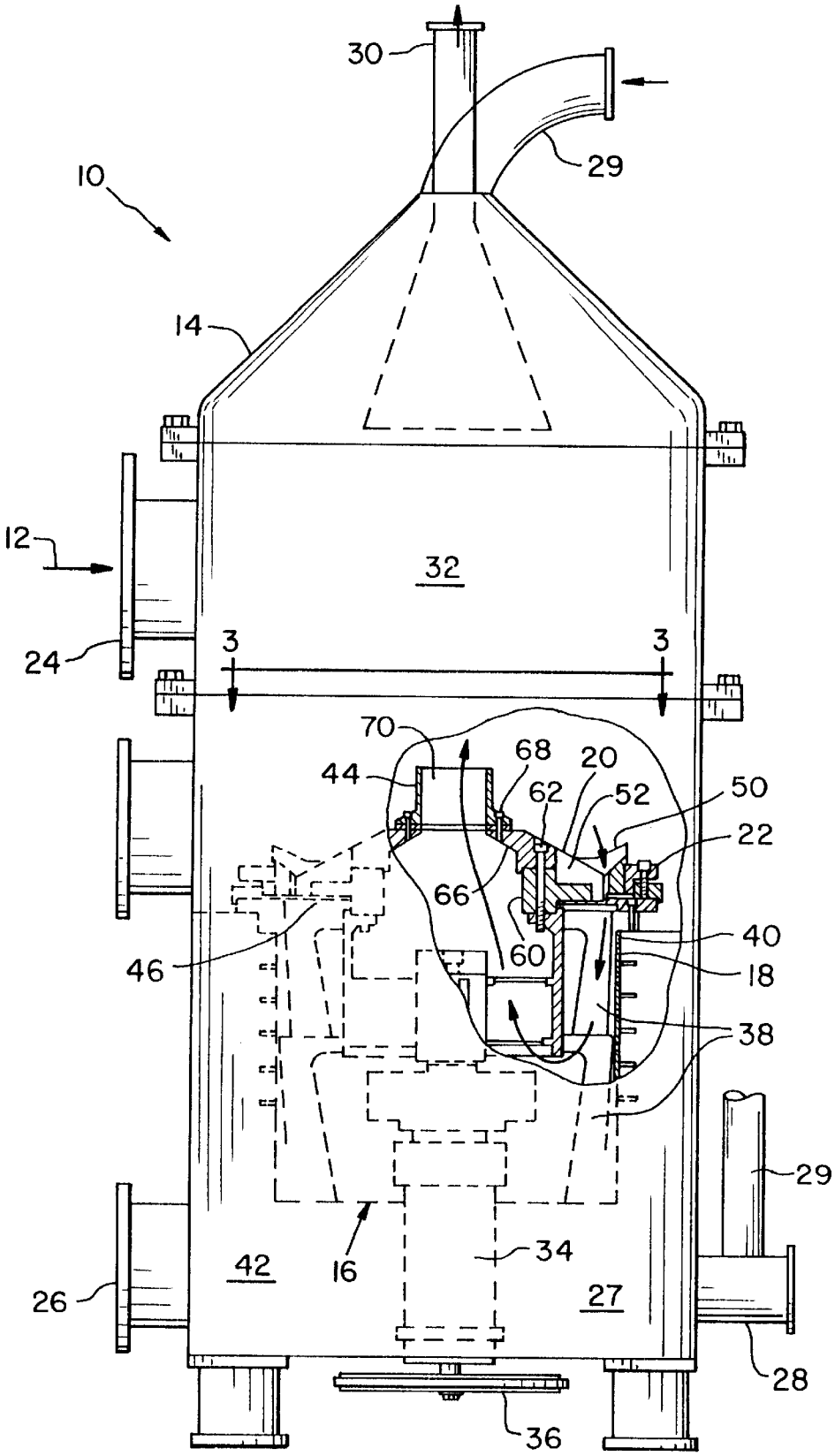
FIG. 1 is a schematic, side view of an embodiment of a screening apparatus of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Figure 2:
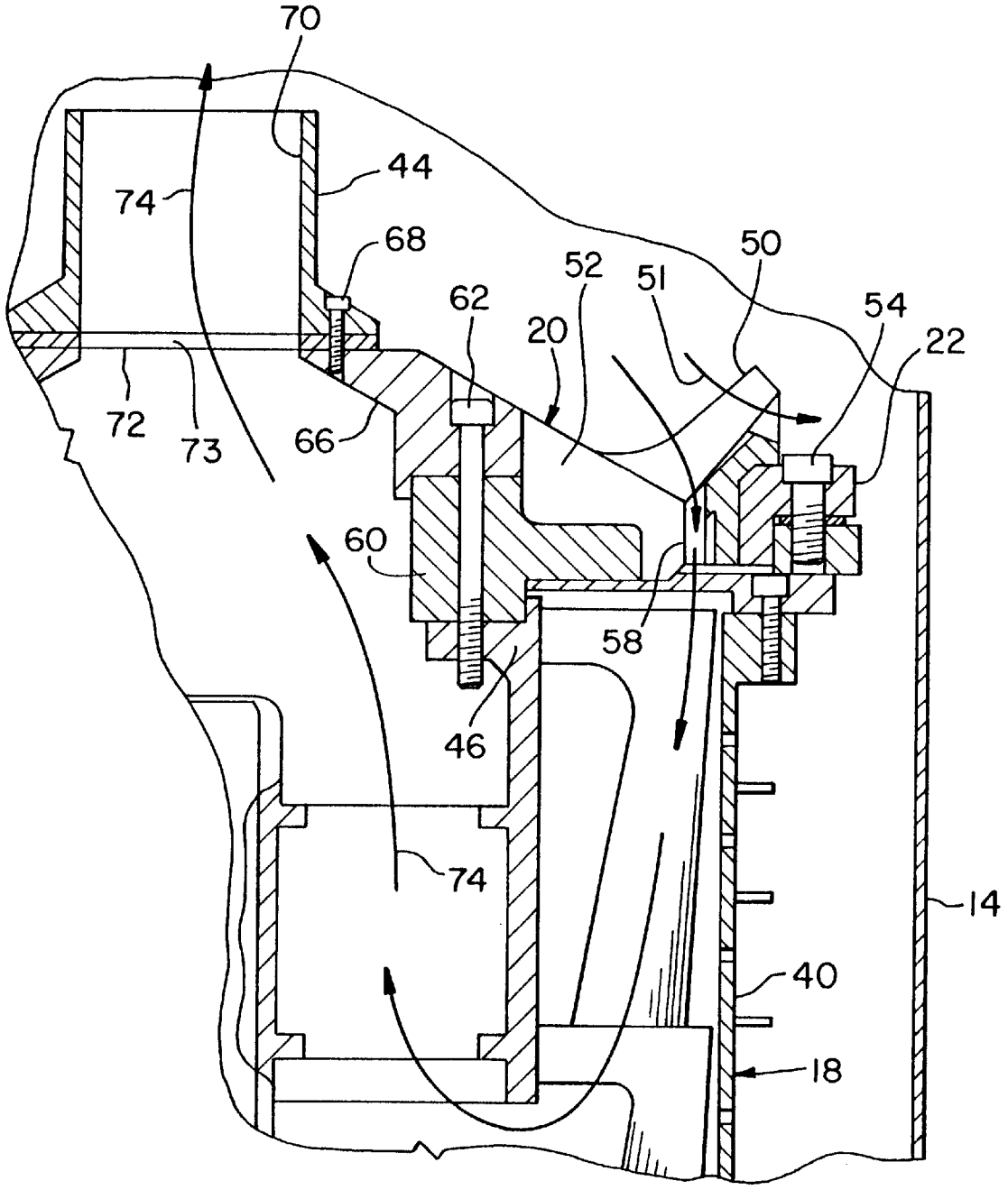
FIG. 2 is an enlarged, fragmentary view of a portion of screening apparatus shown in FIG. 1.

Referring now to the drawings, and more particularly to FIGS. 1 and 2, there is shown an embodiment of a screening apparatus 10 of the present invention for screening acceptable and rejectable material from a pressurized fiber suspension 12. Screening apparatus 10 generally includes a housing 14, rotor 16, screen basket 18, rotor blade ring 20 and stationary defibering ring 22.

Housing 14 defines inlet 24, accepts outlet 26, rejects outlet 28 and lightweight contaminants outlet 30. Fiber suspension to be screened is introduced into a screening chamber 32 adjacent inlet 24 and above rotor blade ring 20. Contaminants such as stickies, plastics, etc. are removed through contaminants outlet 30 via a suitable technique, such as vacuum, etc. Accepts outlet 26 is positioned radially outside screen basket 18 and receives accepts which pass through screen basket 18. Rejects outlet 28 is positioned below rotor 16 and receives rejects for recycling or disposal. An external recirculation pipe 29 fluidly couples rejects outlet 28 with the top of housing 14.

Rotor 16 is rotatably carried within housing 14. More particularly, rotor 16 is mounted on a shaft 34, which in turn is indirectly carried by housing 14. A driven sheave 36 positioned on an end of shaft 34 is driven by a drive source (not shown) for rotatably driving rotor 16. In the embodiment shown, rotor 16 includes a plurality of axially stacked and radially spaced foils 38 which assist in the screening process using screen basket 18 and also assist in cleaning the openings or perforations in screen basket 18.

Screen basket 18 is positioned generally concentrically around and closely adjacent to rotor 16. Screen basket 18 includes at least one screening element 40 having or defining a plurality of openings or perforations for screening the acceptable material from the rejectable material within fiber suspension 12. In the embodiment shown, screen basket 18 is in the form of a sheet or plate metal wall having a plurality of perforations or openings formed therein which allow the acceptable material to pass therethrough. The perforations or openings may be sized and configured dependent upon the particular application of screening apparatus 10. Spaced radially outside of screen basket 18, between screen basket 18 and housing 14, is an accept chamber 42 which is in fluid communication with accepts outlet 26.

Figure 3:
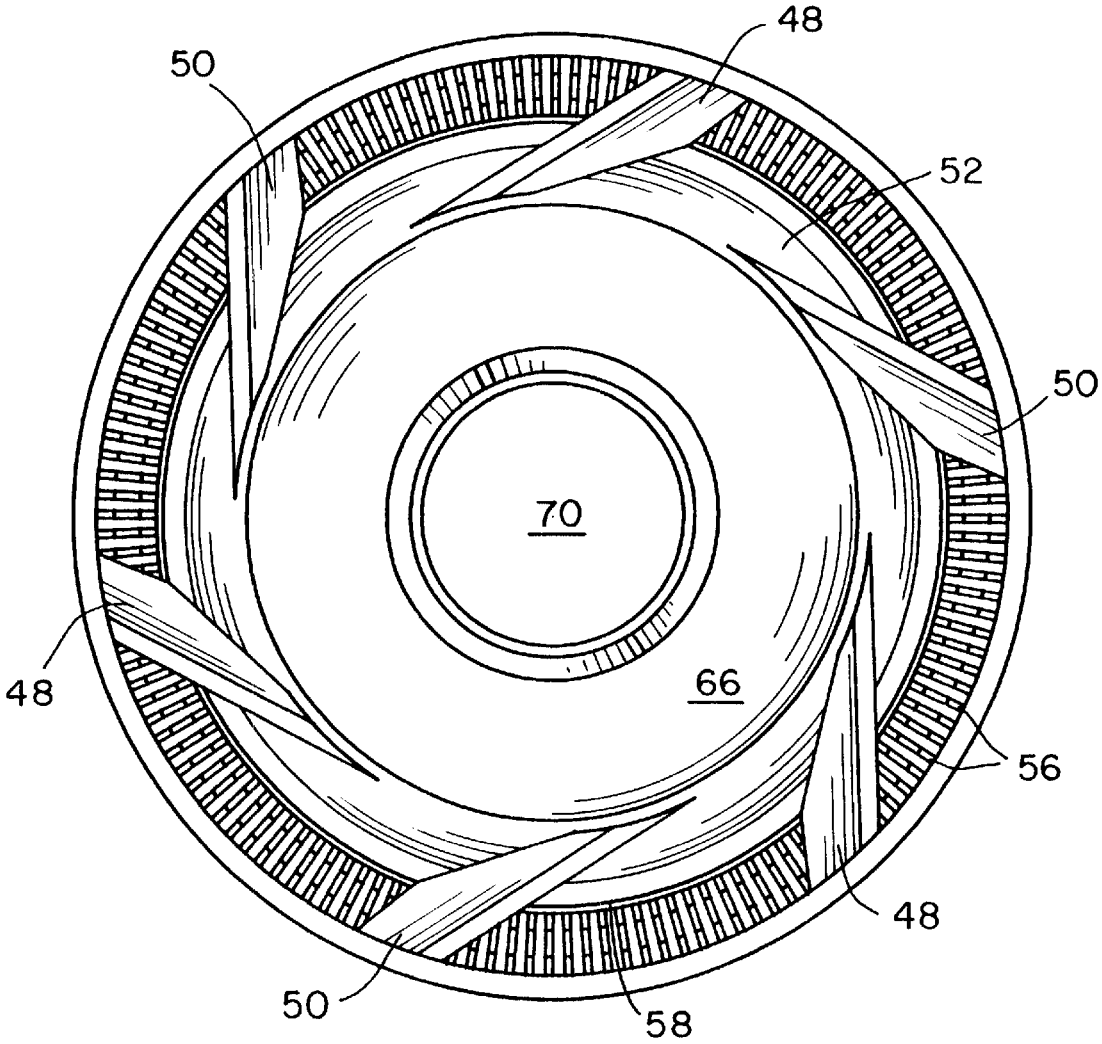
FIG. 3 is a top view as viewed along section line 3—3 in FIG. 1.
Figure 4:
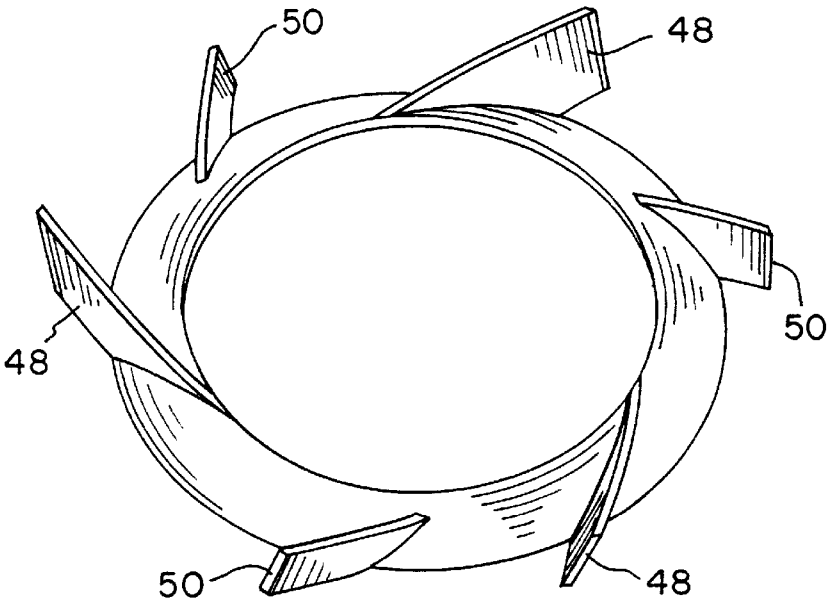
FIG. 4 is a perspective view of the rotor blade ring illustrated in FIGS. 1–3.

According to an aspect of the present invention, screening apparatus 10 includes rotor blade ring 20, stationary defibering ring 22 and vortex enhancer cup 44 positioned above rotor 16 and screen basket 18. Rotor blade ring 20, shown in more detail in FIGS. 3 and 4, is connected to top end 46 of rotor 16 and thereby rotates with rotor 16 during operation. Rotor blade ring 20 includes a plurality of blades 48, 50 extending radially outward from generally frustroconical shaped, annular ring 52. Blades 48 have a height which is greater than the height of blades 50. For example, in a case where rotor blade ring 20 has an outside diameter of approximately 27 inches, blades 48 have a height of about 3 15/16 inches and blades 50 have a height of about 2 3/8 inches. As a further example, when rotor blade ring 20 has an outside diameter of approximately 54 inches, blades 48 have a height of approximately 8 inches and blades 50 have a height of approximately 4 3/4 inches. The differing heights of blades 48 and 50 assist in breaking apart flakes and defibering of fiber suspension within screening chamber 32. The frustroconical shape of annular ring 52 assists in directing the flow of fiber suspension past rotor blade ring 20, as will be described hereinafter.

Stationary defibering ring 22 is positioned adjacent to and below rotor blade ring 20. Stationary defibering ring 22 is attached to and carried by each of housing 14 and screen basket 18 using a suitable fastening technique, such as bolts 54, etc. Stationary defibering ring 22 includes a plurality of perforations 56 which allow defibered fibers to pass therethrough. In the embodiment shown, perforations 56 are in the form of radially extending slots positioned generally adjacent and parallel to each other. However, perforations 56 may be sized and configured dependent upon the particular application, such as with holes, etc. The inside diameter of stationary defibering ring 22 is radially spaced apart from the outside diameter of annular ring 52 of rotor blade ring 20, thereby defining an annular gap 58 therebetween through which a portion of the fiber suspension flows.

Hub 60 is connected to the top end of rotor 16, such as by using a plurality of bolts 62 or the like. Rotor blade ring 20 is in turn attached to and carried by hub 60 using a plurality of fasteners such as bolts (not shown). Rotor blade ring 20 is thus indirectly coupled with and carried by rotor 16 via intermediate hub 60.

Extension hub 66 is connected with the top of hub 60 using bolts 62, and defines a generally frustroconical shaped surface extending radially inwardly above rotor blade ring 20. The frustroconical shape of extension hub 66 assists in directing the flow of fiber suspension to rotor blade ring 20.

Vortex enhancer cup 44 is connected to and carried by extension hub 66 using suitable fasteners, such as bolt 68. The spinning action of vortex enhancer cup 44 causes the formation of a vortex in the flow of fiber suspension within screening chamber 32. The vortex flow action in turn assists in removal of lightweight contaminants through contaminants outlet 30. Vortex enhancer cup 44 also includes an axially extending cavity 70 allowing internal recirculation of the fiber suspension within screening apparatus 10, as will be described in more detail hereinafter.

An optional plate 72 is interposed between extension hub 66 and vortex enhancer cup 44. Plate 72 is provided with one or more appropriately sized and configured openings 73 therein which allow controlled internal recirculation of the fiber suspension within screening apparatus 10. Alternatively, plate 72 is solid and thereby prevents internal recirculation of the fiber suspension within screening apparatus 10.

During use, a fiber suspension to be screened enters inlet 22 under pressure and travels in a generally downward direction toward rotor blade ring 20 via gravitational force. Rotor 16 is rotationally driven by a drive source (not shown) at a particular operating speed. Rotor blade ring 20 is coupled with and rotatably driven by rotor 16. Blades 48 and 50 on rotor blade ring 20 declump and break apart flakes within the fiber suspension as the fiber suspension impinges thereagainst. Deflaked and declumped fibers flow through perforations 56 and gap 58 to rotor 16. Foils 38 of rotor 16 cause pressure pulsations within the fiber suspension adjacent screen basket 18, which in turn causes accepts to flow into accepts chamber 42 at the same time maintaining the openings within screen basket 18 and an open state as a result of the pressure pulsations. Rejects are transported through rejects chamber 27 to rejects outlet 28 and away from screening apparatus 10. A portion or all of the rejects can be recirculated from rejects outlet 28 to screening chamber 32 via external recirculation pipe 29, resulting in improved efficiency of screening apparatus 10. The external recirculation can be controlled by a controllable valve (not shown). Accepts within accepts chamber 42 flow from accepts outlet 26 for further processing. Rejects from rejects outlet 28 can be recycled and/or disposed of, depending upon the particular application. For example, all or a portion of rejects from rejects outlet 28 may be recycled to an appropriate location at screening chamber 32, such as at inlet 24, contaminants outlet 30 or any other suitable location.

With a solid plate 72 installed below vortex enhancer cup 44, no internal recirculation of the fiber suspension occurs within screening apparatus 10. On the other hand, if plate 72 is configured with one or more openings 73, or is removed between vortex enhancer cup 44 and extension cup 66, internal recirculation occurs within screening apparatus 10, as indicated generally at flow directional arrow 74. Internal recirculation as well as the vortex within the flow of fiber suspension causes lightweight contaminants to migrate to the top, center of the fiber suspension adjacent lightweight contaminants outlet 30. Fiber flakes, etc. also flow through blades 48 and 50, as shown by directional arrow 51, resulting in further internal recirculation and improved efficiency within screening apparatus 10. The lightweight contaminants are removed from screening apparatus 10 via contaminants outlet 30 using pressure differentials.

Figure 5:
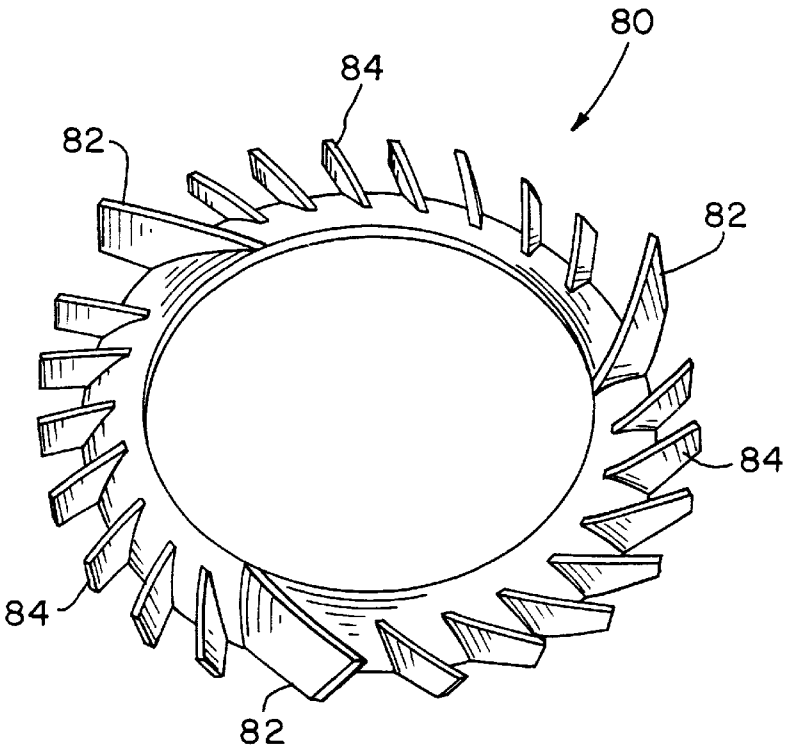
FIG. 5 is a perspective view of another embodiment of a rotor blade ring.

Referring now to FIG. 5, there is shown another embodiment of a rotor blade ring 80 which may be used with a screening apparatus of the present invention. Rotor blade ring 80 is similar to rotor blade ring 20, except that it includes a greater number of blades 82, 84, with the particular number of blades being dependent upon the specific application. In the embodiment shown, rotor blade ring 80 includes twenty-four total blades, with three blades 82 and twenty-one blades 84. Blades 82 have a height which is greater than the height of blades 84. For example, if rotor blade ring 80 has an outside diameter of approximately 27 inches, blades 82 have a height of approximately 4 inches and blades 84 have a height of approximately 1 inch. As a further example, if rotor blade ring 80 has an outside diameter of approximately 54 inches, blades 82 have a height of approximately 8 inches and blades 84 have a height of approximately 2 inches. Rotor blade ring 80 is coupled with hub 60 and thus rotates with rotor 16, as described above, with regard to rotor blade ring 20. Operation of rotor blade ring 80 is substantially the same as that of rotor blade ring 20, and thus will not described in further detail.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A screening apparatus for screening acceptable and rejectable material from a pressurized fiber suspension, said screening apparatus comprising:

a housing;

a rotor within said housing, said rotor having an end;

a screen basket positioned generally concentrically around said rotor;

a rotor blade ring connected to said end of said rotor and rotating with said rotor, said rotor blade ring including at least one rotor blade; and a stationary defibering ring positioned adjacent said rotor blade ring, said stationary defibering ring configured for defibering the pressurized fiber suspension, said end proximate to said stationary defibering ring.

2. The screening apparatus of claim 1, wherein said end is a top end, and said rotor blade ring is connected to said top end.

3. The screening apparatus of claim 2, including a hub interconnecting said rotor and said rotor blade ring.

4. The screening apparatus of claim 1, said rotor blade ring including a plurality of blades extending radially outward.

5. The screening apparatus of claim 4, said plurality of blades being positioned above said defibering ring.

6. The screening apparatus of claim 4, said plurality of blades including at least one of a plurality of different shapes and a plurality of different sizes.

7. The screening apparatus of claim 1, wherein said housing and said screen basket define an accept chamber.

8. The screening apparatus of claim 1, wherein said housing defines a screening chamber and a rejects chamber, and further including an external recirculation pipe fluidly interconnecting said rejects chamber with said screening chamber.

9. In a screening apparatus, a method of screening acceptable and rejectable material from a pressurized fiber suspension, said method comprising the steps of:

providing a housing; a rotor within said housing; a screen basket positioned generally concentrically around said rotor; a rotor blade ring connected to an end of said rotor and rotating with said rotor, said rotor blade ring including a plurality of blades extending radially outward; and a stationary defibering ring positioned adjacent and under said rotor blades, said stationary defibering ring configured for defibering the pressurized fiber suspension, said end proximate to said stationary defibering ring;

transporting a fiber suspension into said housing above said rotor blade ring;

breaking apart flakes in the fiber suspension using said rotor blade ring;

defibering fibers within the fiber suspension using said defibering ring; and separating accepts from the fiber suspension using said screen basket.

10. A screening apparatus for screening acceptable and rejectable material from a pressurized fiber suspension, said screening apparatus comprising:

a housing;

a rotor within said housing, said rotor having an end;

a screen basket positioned generally concentrically around said rotor;

a rotor blade ring connected to said end of said rotor and rotating with said rotor; and a stationary defibering ring positioned adjacent said rotor blade ring, said defibering ring including a plurality of perforations.

11. The screening apparatus of claim 10, wherein said perforations are at least one of slots and holes.

12. A screening apparatus for screening acceptable and rejectable material from a pressurized fiber suspension, said screening apparatus comprising:

a housing;

a rotor within said housing, said rotor having an end;

a screen basket positioned generally concentrically around said rotor;

a rotor blade ring connected to said end of said rotor and rotating with said rotor;

a stationary defibering ring positioned adjacent said rotor blade ring; and a vortex enhancer cup connected with said rotor blade ring.

13. The screening apparatus of claim 12, including a hub connecting between said rotor and said rotor blade ring, and an extension hub interconnecting said hub and said vortex enhancer cup.

14. The screening apparatus of claim 12, said vortex enhancer cup including an axially extending cavity allowing internal recirculation within said screening apparatus.

15. The screening apparatus of claim 14, including a plate disposed between said vortex enhancer cup and said hub for preventing the internal recirculation.

16. In a screening apparatus, a method of screening acceptable and rejectable material from a pressurized fiber suspension, said method comprising the steps of:

providing a housing; a rotor within said housing; a screen basket positioned generally concentrically around said rotor; a rotor blade ring connected to a top end of said rotor and rotating with said rotor, said rotor blade ring including a plurality of blades extending radially outward; and a stationary defibering ring positioned adjacent and under said rotor blades;

transporting a fiber suspension into said housing above said rotor blade ring;

breaking apart flakes in the fiber suspension using said rotor blade ring;

defibering fibers within the fiber suspension using said defibering ring;

separating accepts from the fiber suspension using said screen basket;

providing a vortex enhancer cup connected with said rotor blade ring, said vortex enhancer cup including an axially extending cavity; and recirculating the fiber suspension through said axially extending cavity internally within said screening apparatus.

17. The method of claim 16, including the steps of:

attaching a plate to said vortex enhancer cup; and carrying out said recirculating step through said plate.

* * * * *